US007455902B2

(12) United States Patent
Weerawarna et al.

(10) Patent No.: US 7,455,902 B2
(45) Date of Patent: Nov. 25, 2008

(54) MIXED POLYMER SUPERABSORBENT FIBERS

(75) Inventors: S. Ananda Weerawarna, Seattle, WA (US); Mengkui Luo, Auburn, WA (US); Bing Su, Federal Way, WA (US); Alena Michalek, Auburn, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 11/537,849

(22) Filed: Oct. 2, 2006

(65) Prior Publication Data

US 2008/0081190 A1 Apr. 3, 2008

(51) Int. Cl.
*B32B 25/02* (2006.01)

(52) U.S. Cl. ..... 428/296.7; 442/361

(58) Field of Classification Search ..... 442/361; 428/296.7

See application file for complete search history.

(56) References Cited

U.S. PATENT DOCUMENTS

| | | | | |
|---|---|---|---|---|
| 4,128,692 | A | 12/1978 | Reid | |
| 4,143,163 | A | 3/1979 | Hutchison et al. | |
| 4,273,118 | A * | 6/1981 | Smith | 604/375 |
| 5,847,031 | A | 12/1998 | Klimmek et al. | |
| 2007/0179291 | A1 * | 8/2007 | Thibodeau et al. | 536/47 |

* cited by examiner

*Primary Examiner*—Lynda Salvatore
(74) *Attorney, Agent, or Firm*—Christensen O'Connor Johnson Kindness

(57) ABSTRACT

A mixed polymer composite fiber including a carboxyalkyl cellulose and a galactomannan polymer or glucomannan polymer.

15 Claims, 3 Drawing Sheets

MIXED POLYMER SUPERABSORBENT FIBERS

BACKGROUND OF THE INVENTION

Personal care absorbent products, such as infant diapers, adult incontinent pads, and feminine care products, typically contain an absorbent core that includes superabsorbent polymer particles distributed within a fibrous matrix. Superabsorbents are water-swellable, generally water-insoluble absorbent materials having a high absorbent capacity for body fluids. Superabsorbent polymers (SAPs) in common use are mostly derived from acrylic acid, which is itself derived from petroleum oil, a non-renewable raw material. Acrylic acid polymers and SAPs are generally recognized as not being biodegradable. Despite their wide use, some segments of the absorbent products market are concerned about the use of non-renewable petroleum oil derived materials and their non-biodegradable nature. Acrylic acid based polymers also comprise a meaningful portion of the cost structure of diapers and incontinent pads. Users of SAP are interested in lower cost SAPs. The high cost derives in part from the cost structure for the manufacture of acrylic acid which, in turn, depends upon the fluctuating price of petroleum oil. Also, when diapers are discarded after use they normally contain considerably less than their maximum or theoretical content of body fluids. In other words, in terms of their fluid holding capacity, they are "over-designed". This "over-design" constitutes an inefficiency in the use of SAP. The inefficiency results in part from the fact that SAPs are designed to have high gel strength (as demonstrated by high absorbency under load or AUL). The high gel strength (upon swelling) of currently used SAP particles helps them to retain a lot of void space between particles, which is helpful for rapid fluid uptake. However, this high "void volume" simultaneously results in there being a lot of interstitial (between particle) liquid in the product in the saturated state. When there is a lot of interstitial liquid the "rewet" value or "wet feeling" of an absorbent product is compromised.

In personal care absorbent products, U.S. southern pine fluff pulp is commonly used in conjunction with the SAP. This fluff is recognized worldwide as the preferred fiber for absorbent products. The preference is based on the fluff pulp's advantageous high fiber length (about 2.8 mm) and its relative ease of processing from a wetland pulp sheet to an airlaid web. Fluff pulp is also made from renewable and biodegradable cellulose pulp fibers. Compared to SAP, these fibers are inexpensive on a per mass basis, but tend to be more expensive on a per unit of liquid held basis. These fluff pulp fibers mostly absorb within the interstices between fibers. For this reason, a fibrous matrix readily releases acquired liquid on application of pressure. The tendency to release acquired liquid can result in significant skin wetness during use of an absorbent product that includes a core formed exclusively from cellulosic fibers. Such products also tend to leak acquired liquid because liquid is not effectively retained in such a fibrous absorbent core.

Superabsorbent produced in fiber form has a distinct advantage over particle forms in some applications. Such superabsorbent fiber can be made into a pad form without added non superabsorbent fiber. Such pads will also be less bulky due to elimination or reduction of the non superabsorbent fiber used. Liquid acquisition will be more uniform compared to a fiber pad with shifting superabsorbent particles.

A need therefore exists for a fibrous superabsorbent material that is simultaneously made from a biodegradable renewable resource like cellulose that is inexpensive. In this way, the superabsorbent material can be used in absorbent product designs that are efficient. These and other objectives are accomplished by the invention set forth below.

SUMMARY OF THE INVENTION

The present invention provides a mixed polymer composite fiber. The mixed polymer composite fiber includes a carboxyalkyl cellulose and a galactomannan polymer or a glucomannan polymer. The fiber includes a plurality of non-permanent intra-fiber metal crosslinks.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
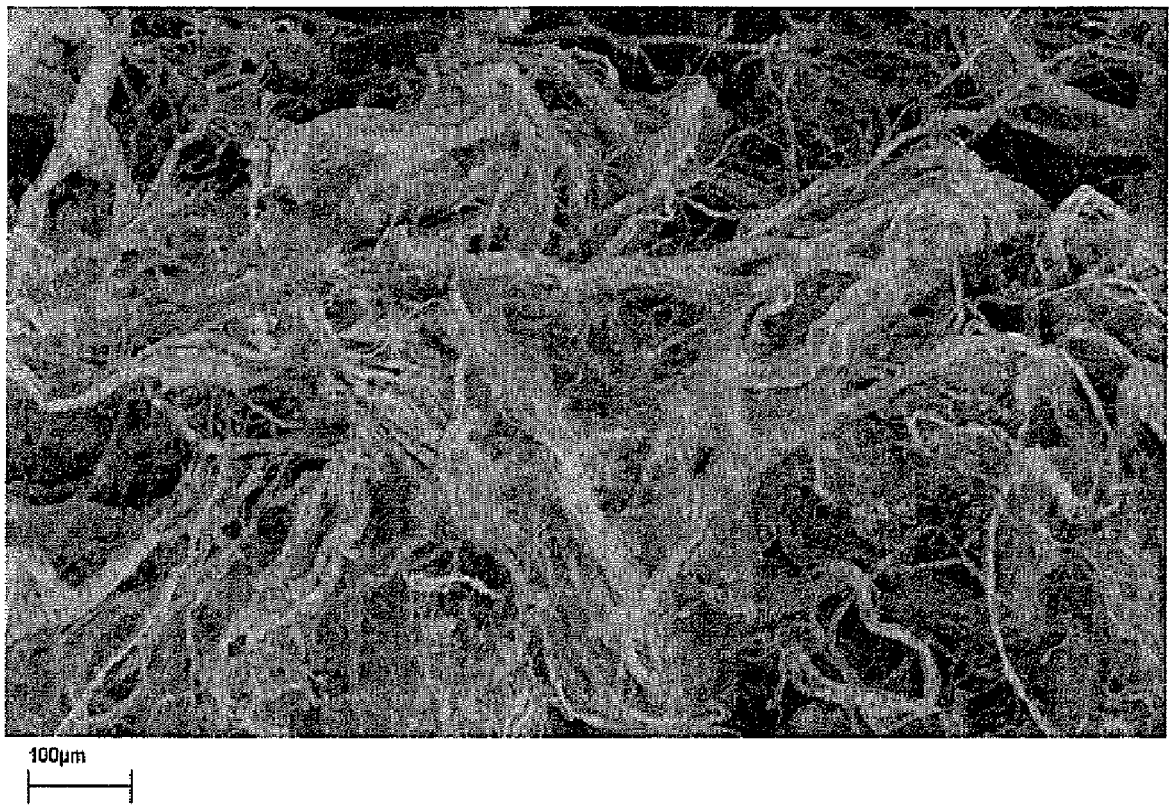
FIG. 1 is a scanning electron microscope photograph (100×) of representative mixed polymer composite fibers of the invention.

The present invention provides a mixed polymer composite fiber. Methods for making the mixed polymer composite fiber are also described. The mixed polymer composite fiber is a fiber comprising a carboxyalkyl cellulose and a galactomannan polymer or a glucomannan polymer. The carboxyalkyl cellulose, which is mainly in the sodium salt form, can be in other salts forms such as potassium and ammonium forms. The mixed polymer composite fiber is formed by intermolecular crosslinking of mixed polymer molecules, and is water insoluble and water-swellable.

In one aspect, the present invention provides a mixed polymer composite fiber. As used herein, the term "mixed polymer composite fiber" refers to a fiber that is the composite of two different polymer molecules (i.e., mixed polymer molecules). The mixed polymer composite fiber is a homogeneous composition that includes two associated polymers: (1) a carboxyalkyl cellulose and (2) either a galactomannan polymer or a glucomannan polymer.

The carboxyalkyl cellulose useful in making the mixed polymer composite fiber has a degree of carboxyl group substitution (DS) of from about 0.3 to about 2.5. In one embodiment, the carboxyalkyl cellulose has a degree of carboxyl group substitution of from about 0.5 to about 1.5.

Although a variety of carboxyalkyl celluloses are suitable for use in making the mixed polymer composite fiber, in one embodiment, the carboxyalkyl cellulose is carboxymethyl cellulose. In another embodiment, the carboxyalkyl cellulose is carboxyethyl cellulose.

The carboxyalkyl cellulose is present in the mixed polymer composite fiber in an amount from about 60 to about 99% by weight based on the weight of the mixed polymer composite fiber. In one embodiment, the carboxyalkyl cellulose is present in an amount from about 80 to about 95% by weight based on the weight of the mixed polymer composite fiber. In addition to carboxyalkyl cellulose derived from wood pulp containing some carboxyalkyl hemicellulose, carboxyalkyl cellulose derived from non-wood pulp, such as cotton linters, is suitable for preparing the mixed polymer composite fiber. For carboxyalkyl cellulose derived from wood products, the mixed polymer fibers include carboxyalkyl hemicellulose in an amount up to about 20% by weight based on the weight of the mixed polymer composite fiber.

The galactomannan polymer useful in making the mixed polymer composite fiber of the invention can include any one of a variety of galactomannan polymers. In one embodiment, the galactomannan polymer is guar gum. In another embodiment, the galactomannan polymer is locust bean gum. In a further embodiment, the galactomannan polymer is tara gum. In another embodiment, the galactomannan polymer is fenugreek gum.

The glucomannan polymer useful in making the mixed polymer composite fiber of the invention can include any one of a variety of glucomannan polymers. In one embodiment, the glucomannan polymer is konjac gum.

The galactomannan polymer or glucomannan polymer is present in an amount from about 1 to about 20% by weight based on the weight of the mixed polymer composite fiber. In one embodiment, the galactomannan polymer or glucomannan polymer is present in an amount from about 1 to about 15% by weight based on the weight of the mixed polymer composite fiber. In a further embodiment, the galactomannan polymer or glucomannan polymer is present in an amount from about 2 to about 15% by weight based on the weight of the mixed polymer composite fiber.

The preparation of the mixed polymer composite fiber is a multistep process. First, the water-soluble carboxyalkyl cellulose and galactomannan polymer or glucomannan polymer are dissolved in water. Then, a first crosslinking agent is added and mixed to obtain a mixed polymer composite gel formed by intermolecular crosslinking of water-soluble polymers.

Suitable first crosslinking agents include crosslinking agents that are reactive towards hydroxyl groups and carboxyl groups. Representative crosslinking agents include metallic crosslinking agents, such as aluminum (III) compounds, titanium (IV) compounds, bismuth (III) compounds, boron (III) compounds, and zirconium (IV) compounds. The numerals in parentheses in the preceding list of metallic crosslinking agents refers to the valency of the metal.

The mixed polymer composite fiber is generated by rapid mixing of the mixed polymer composite gel with a water-miscible solvent. This fiber generated after first crosslinking has a high level of sliminess when hydrated and forms soft gels. Therefore this fiber cannot be used in absorbent applications without further treatment. The mixed polymer composite fiber thus obtained is further crosslinked (e.g., surface crosslinked) by treating with a second crosslinking agent in a water-miscible solvent containing water. The composition of water-miscible solvent and water is such that the fiber does not change its fiber form and return to gel state. The second crosslinking agent can be the same as or different from the first crosslinking agent.

The mixed polymer fibers of the invention are substantially insoluble in water while being capable of absorbing water. The fibers of the invention are rendered water insoluble by virtue of a plurality of non-permanent intra-fiber metal crosslinks. As used herein, the term "non-permanent intra-fiber metal crosslinks" refers to the nature of the crosslinking that occurs within individual modified fibers of the invention (i.e., intra-fiber) and among and between each fiber's constituent polymer molecules.

The fibers of the invention are intra-fiber crosslinked with metal crosslinks. The metal crosslinks arise as a consequence of an associative interaction (e.g., bonding) between functional groups (e.g., carboxy, carboxylate, or hydroxyl groups) of the fiber's polymers and a multi-valent metal species. Suitable multi-valent metal species include metal ions having a valency of three or greater and that are capable of forming associative interpolymer interactions with functional groups of the polymer molecules (e.g., reactive toward associative interaction with the carboxy, carboxylate, or hydroxyl groups). The polymers are crosslinked when the multi-valent metal species form associative interpolymer interactions with functional groups on the polymers. A crosslink may be formed intramolecularly within a polymer or may be formed intermolecularly between two or more polymer molecules within a fiber. The extent of intermolecular crosslinking affects the water solubility of the composite fibers (i.e., the greater the crosslinking, the greater the insolubility) and the ability of the fiber to swell on contact with an aqueous liquid.

The fibers of the invention include non-permanent intrafiber metal crosslinks formed both intermolecularly and intramolecularly in the population of polymer molecules. As used herein, the term "non-permanent crosslink" refers to the metal crosslink formed with two or more functional groups of a polymer molecule (intramolecularly) or formed with two or more functional groups of two or more polymer molecules (intermolecularly). It will be appreciated that the process of dissociating and re-associating (breaking and reforming crosslinks) the multi-valent metal ion and polymer molecules is dynamic and also occurs during Liquid acquisition. During water acquisition the individual fibers and fiber bundles swell and change to gel state. The ability of non-permanent metal crosslinks to dissociate and associate under water acquisition imparts greater freedom to the gels to expand than if the gel was restrictively crosslinked by permanent crosslinks that do not have the ability to dissociate and re-associate. Covalent organic crosslinks, such as ether crosslinks, are permanent crosslinks that do not dissociate and re-associate.

The fibers of the invention are prepared fiber bundles, which are aggregates that include a plurality of the fibers. The fibers of the invention have fiber widths of from about 2 μm to about 50 μm (or greater) and coarseness that varies from soft to rough.

Figure 2:
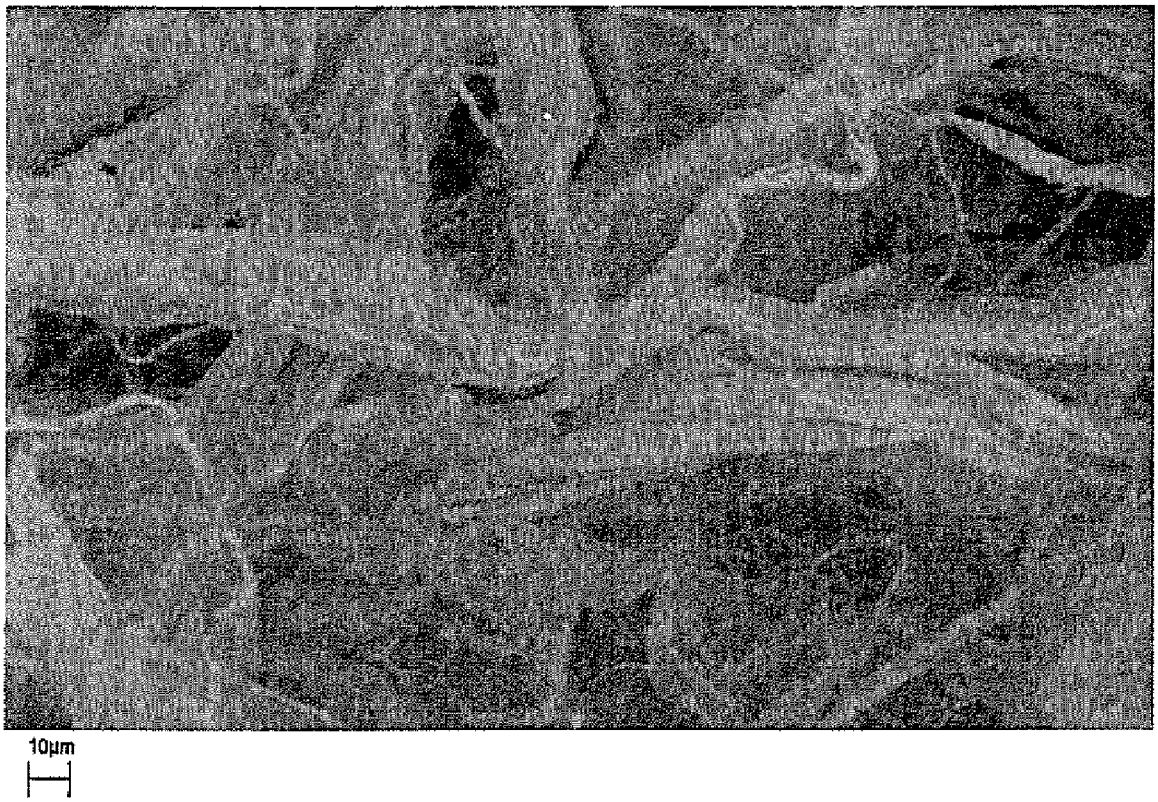
FIG. 2 is a scanning electron microscope photograph (400×) of representative mixed polymer composite fibers of the invention.
Figure 3:
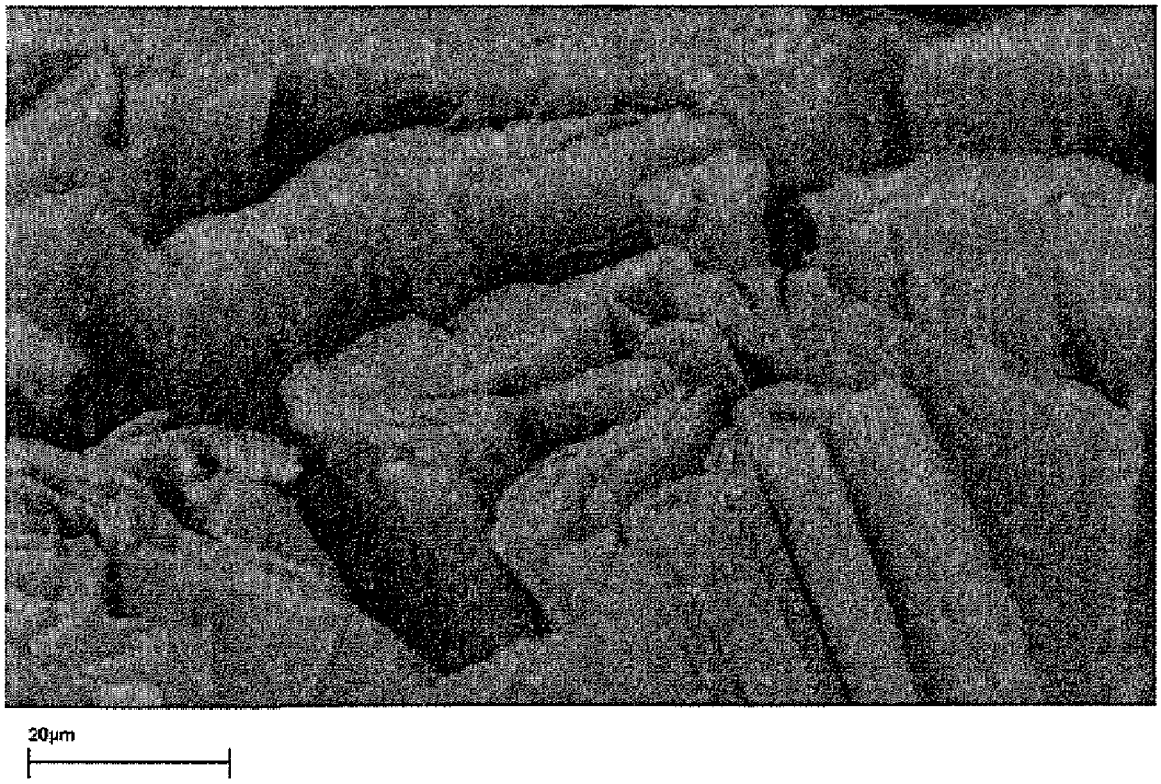
FIG. 3 is a scanning electron microscope photograph (1000×) of representative mixed polymer composite fibers of the invention.

Representative mixed polymer composite fibers of the invention are illustrated in FIGS. 1-3. FIG. 1 is a scanning electron microscope photograph (100×) of representative mixed polymer composite fibers of the invention (Sample 31, Table 1). FIG. 2 is a scanning electron microscope photograph (400×) of representative mixed polymer composite fibers of the invention (Sample 31, Table 1). FIG. 3 is a scanning electron microscope photograph (1000×) of representative mixed polymer composite fibers of the invention (cross-sectional view) (Sample 125, Table 1).

The fibers of the invention are highly absorptive fibers. The fibers have a Free Swell Capacity of from about 30 to about 60 g/g (0.9% saline solution), a Centrifuge Retention Capacity (CRC) of from about 15 to about 35 g/g (0.9% saline solution), and an Absorbency Under Load (AUL) of from about 15 to about 30 g/g (0.9% saline solution).

The fibers of the invention can be formed into pads by conventional methods including air-laying techniques to provide fibrous pads having a variety of liquid wicking characteristics. For example, pads absorb liquid at a rate of from about 10 ml/sec to about 0.005 ml/sec (0.9% saline solution/10 ml application). The integrity of the pads can be varied from soft to very strong.

The mixed polymer composite fibers of the present invention are water insoluble and water swellable. Water insolubility is imparted to the fiber by intermolecular crosslinking of the mixed polymer molecules, and water swellability is imparted to the fiber by the presence of carboxylate anions with associated cations. The fibers are characterized as having a relatively high Liquid absorbent capacity for water (e.g., pure water or aqueous solutions, such as salt solutions or biological solutions such as urine). Furthermore, because the mixed polymer fiber has the structure of a fiber, the mixed polymer composite fiber also possesses the ability to wick liquids. The mixed polymer composite fiber of the invention advantageously has dual properties of high liquid absorbent capacity and liquid wicking capacity.

Mixed polymer fibers having slow wicking ability of fluids are useful in medical applications, such as wound dressings and others. Mixed polymer fibers having rapid wicking capacity for urine are useful in personal care absorbent product applications. The mixed polymer fibers can be prepared having a range of wicking properties from slow to rapid for water and 0.9% aqueous saline solutions.

The mixed polymer composite fibers of the invention are useful as superabsorbents in personal care absorbent products (e.g., infant diapers, feminine care products and adult incontinence products). Because of their ability to wick liquids and to absorb liquids, the mixed polymer composite fibers of the invention are useful in a variety of other applications, including, for example, wound dressings, cable wrap, absorbent sheets or bags, and packaging materials.

The mixed polymer composite fibers are prepared by methods in which the fibers are generated from solution and formed into fibers during the solvent exchange process under shear mixing conditions. As noted above, fiber formation results from shear mixing the gel with the water-miscible solvent and effects solvent exchange and generation of composite fiber in the resultant mixed solvent.

The method for making the mixed polymer composite fibers (crosslinked fibers) includes the steps of: (a) blending a carboxyalkyl cellulose (e.g., mainly salt form) and a galactomannan polymer or a glucomannan polymer in water to provide an aqueous solution; (b) treating the aqueous solution with a first crosslinking agent to provide a gel; (c) mixing the gel with a water-miscible solvent to provide fibers; and (d) treating the fibers with a second crosslinking agent (e.g., surface crosslinking) to provide mixed polymer composite fibers. The mixed polymer composite fibers so prepared can be fiberized and dried.

In the process, a carboxyalkyl cellulose and a galactomannan polymer or a glucomannan polymer are blended in water to provide an aqueous solution.

Suitable carboxyalkyl celluloses have a degree of carboxyl group substitution of from about 0.3 to about 2.5, and in one embodiment have a degree of carboxyl group substitution of from about 0.5 to about 1.5. In one embodiment, the carboxyalkyl cellulose is carboxymethyl cellulose. The aqueous solution includes from about 60 to about 99% by weight carboxyalkyl cellulose based on the weight of the product mixed polymer composite fiber. In one embodiment, the aqueous solution includes from about 80 to about 95% by weight carboxyalkyl cellulose based on the weight of mixed polymer composite fiber.

Suitable galactomannan polymers include guar gum, locust bean gum, tara gum, and fenugreek gum. Suitable glucomannan polymers include konjac gum. The galactomannan polymer or glucomannan polymer can be from natural sources or obtained from genetically-modified plants. The aqueous solution includes from about 1 to about 20% by weight galactomannan polymer or glucomannan polymer based on the weight of the mixed polymer composite fiber, and in one embodiment, the aqueous solution includes from about 1 to about 15% by weight galactomannan polymer or glucomannan polymer based on the weight of mixed polymer composite fibers.

In the method, the aqueous solution including the carboxyalkyl cellulose and galactomannan polymer or glucomannan polymer is treated with a suitable amount of a first crosslinking agent to provide a gel.

Suitable first crosslinking agents include crosslinking agents that are reactive towards hydroxyl groups and carboxyl groups. Representative crosslinking agents include metallic crosslinking agents, such as aluminum (III) compounds, titanium (IV) compounds, bismuth (III) compounds, boron (III) compounds, and zirconium (IV) compounds. The numerals in parentheses in the preceding list of metallic crosslinking agents refers to the valency of the metal.

Representative metallic crosslinking agents include aluminum sulfate; aluminum hydroxide; dihydroxy aluminum acetate (stabilized with boric acid); other aluminum salts of carboxylic acids and inorganic acids; other aluminum complexes, such as Ultrion 8186 from Nalco Company (aluminum chloride hydroxide); boric acid; sodium metaborate; ammonium zirconium carbonate; zirconium compounds containing inorganic ions or organic ions or neutral ligands; bismuth ammonium citrate; other bismuth salts of carboxylic acids and inorganic acids; titanium (IV) compounds, such as titanium (IV) bis(triethylaminato) bis(isopropoxide) (commercially available from the Dupont Company under the designation Tyzor TE); and other titanates with alkoxide or carboxylate ligands.

The first crosslinking agent is effective for associating and crosslinking the carboxyalkyl cellulose (with or without carboxyalkyl hemicellulose) and galactomannan polymer molecules. The first crosslinking agent is applied in an amount of from about 0.1 to about 20% by weight based on the total weight of the mixed polymer composite fiber. The amount of first crosslinking agent applied to the polymers will vary depending on the crosslinking agent. In general, the fibers have an aluminum content of about 0.04 to about 0.8% by weight based on the weight of the mixed polymer composite fiber for aluminum crosslinked fibers, a titanium content of about 0.10 to about 1.5% by weight based on the weight of the mixed polymer composite fiber for titanium crosslinked fibers, a zirconium content of about 0.09 to about 2.0% by weight based on the weight of the mixed polymer composite fiber for zirconium crosslinked fibers, and a bismuth content of about 0.90 to about 5.0% by weight based on the weight of the mixed polymer composite fiber for bismuth crosslinked fibers.

The gel formed by treating the aqueous solution of a carboxyalkyl cellulose and a galactomannan polymer with a first crosslinking agent is then mixed with a water-miscible solvent to provide fibers. Suitable water-miscible solvents include water-miscible alcohols and ketones. Representative water-miscible solvents include acetone, methanol, ethanol, isopropanol, and mixtures thereof. In one embodiment, the water-miscible solvent is ethanol. In another embodiment, the water-miscible solvent is isopropanol.

The volume of water-miscible solvent added to the gel ranges from about 1:1 to about 1:5 water (the volume used in making the aqueous solution of carboxyalkyl cellulose and galactomannan polymer) to water-miscible solvent.

In the method, mixing the gel with the water-miscible solvent includes stirring to provide fibers. The mixing step and the use of the water-miscible solvent controls the rate of dehydration and solvent exchange and provides for fiber formation. Mixing can be carried out using a variety of devices including overhead stirrers, Hobart mixers, British disintegrators, and blenders. For these mixing devices, the blender provides the greatest shear and the overhead stirrer provides the least shear. As noted above, fiber formation results from mixing with the water-miscible solvent and effects solvent exchange and dehydration. The nature of fiber produced by the mixing step can be controlled by the type of mixer, rate of mixing, and the percent solids in water (i.e., the amount of carboxyalkyl cellulose and galactomannan polymer present in the aqueous solution prior to addition of the water-miscible solvent).

For 1% solids in water, overhead mixers and stirrers including, for example, spiral mixers, provide relatively coarse fibers. These fibers may have the form of shredded paper. Fine fibers are produced using high shear devices, such as a blender (high speed Waring blender). These fine fibers have the appearance of disintegrated cotton fibers. In use, coarse fibers are advantageous for wicking and for avoiding gel blocking during water acquisition and change of fiber form to gel form. Fine fibers are subject to gel blocking, which results from fibers swelling and the collapse of interstitial channels useful for liquid wicking during water acquisition and change of fiber form to gel form.

For 2% solids in water, overhead mixers and stirrers provide fewer coarse fibers than in the 1% solids in water, and high shear devices, such as a blender, produce a fine fiber that is relatively more coarse than that produced in the 1% solids in water.

For 4% solids in water, relatively higher shear devices, such as a blender, produce fine fibers that are relatively more coarse than the fine fibers produced in the 1% solids in water.

Increasing percent solids in water beyond 4% may require an increase in temperature to achieve fiber formation. Percent solids in water greater than 4% are advantageous for increased throughput and therefore lower cost of production.

In one embodiment, mixing the gel with a water-miscible solvent to provide fibers comprises mixing a 1 or 2% solids in water with an overhead mixer or stirrer. In another embodiment, mixing the gel with a water-miscible solvent to provide fibers comprises mixing 4% solids in water with a blender. For large scale production alternative mixing equipment with suitable mixing capacities are used.

Fibers formed from the mixing step are treated with a second crosslinking agent in a mixture of water and a water miscible solvent in suitable proportions so that the fibers do not lose their fiber form and form a gel. The resultant crosslinked fibers (e.g., surface crosslinked fibers) are then washed with a water-miscible solvent and air dried or oven dried below 80° C. to provide the mixed polymer composite fibers.

The second crosslinking agent is effective in further crosslinking (e.g., surface crosslinking) the mixed polymer composite fibers. Suitable second crosslinking agents include crosslinking agents that are reactive towards hydroxyl groups and carboxyl groups. The second crosslinking agent can be the same as or different from the first crosslinking agent. Representative second crosslinking agents include the metallic crosslinking agents noted above useful as the first crosslinking agents.

The second crosslinking agent can be applied at a relatively higher level than the first crosslinking agent per unit mass of fiber. This provides a higher degree of crosslinking on the surface of the fiber relative to the interior of the fiber. As described above, metal crosslinking agents form crosslinks between carboxylate anions and metal atoms or hydroxyloxygen and metal atoms. These crosslinks can migrate from one oxygen atom to another when the mixed polymer fiber absorbs water and forms a gel. However, having a higher level of crosslinks on the surface of the fiber relative to the interior provides a superabsorbent fiber with a suitable balance in free swell, centrifuge retention capacity, absorbency under load for aqueous solutions and lowers the gel blocking that inhibits liquid transport.

The second crosslinking agent is applied in an amount from about 0.1 to about 20% by weight based on the total weight of mixed polymer composite fibers. The amount of second crosslinking agent applied to the polymers will vary depending on the crosslinking agent. The product fibers have an aluminum content of about 0.04 to about 2.0% by weight based on the weight of the mixed polymer composite fiber for aluminum crosslinked fibers, a titanium content of about 1.0 to about 4.5% by weight based on the weight of the mixed polymer composite fiber for titanium crosslinked fibers, a zirconium content of about 0.09 to about 6.0% by weight based on the weight of the mixed polymer composite fiber for zirconium crosslinked fibers; and a bismuth content of about 0.09 to about 5.0% by weight based on the weight of the mixed polymer composite fiber for bismuth crosslinked fibers.

The second crosslinking agent may be the same as or different from the first crosslinking agent. Mixtures of two or more crosslinking agents in different ratios may be used in each crosslinking step.

The preparation of representative mixed polymer composite fibers of the invention are described in Examples 1-8.

The absorbent properties of the representative mixed polymer composite fibers are summarized in the Table 1. In Table 1, "CMC 9H4F" refers to a carboxymethyl cellulose commercially available from Hoechst Celanese under that designation; "PA-CMC" refers to CMC made from northern softwood pulp; "LV-PN" refers to CMC made from west coast pine pulp; "LV-HW" refers to CMC made from west coast hardwood pulp; "LV-FIR" refers to CMC made from douglas fir pulp; and "KL-SW" refers to CMC made from northern softwood pulp; "i-PrOH" refers to isopropanol; "w wash" refers to washing the treated fibers with 100% ethanol or 100% isopropanol before drying; and "wo washing" refers to the process in which the treated fibers are not washed before drying.

The metal analysis for select representative mixed polymer composite fibers is summarized in the Table 2. Samples 1A, 2A, 3A and 4A refers to Samples 1, 2, 3, and 4, respectively, without treatment with a second crosslinking agent.

In Tables 1 and 2, "% wgt total wgt, applied" refers to the amount of first crosslinking agent applied to the total weight of CMC and guar gum; "Second crosslinking agent/2 g" refers to the amount of second crosslinking agent applied per 2 g first crosslinked product; "BA" refers to boric acid, and "EtOH" refers to ethanol.

Test Methods

Free Swell and Centrifuge Retention Capacities

The materials, procedure, and calculations to determine free swell capacity (g/g) and centrifuge retention capacity (CRC) (g/g) were as follows.

Test Materials:

Japanese pre-made empty tea bags (available from Drugstore.com, IN PURSUIT OF TEA polyester tea bags 93 mm×70 mm with fold-over flap. (http:www.mesh.ne.jp/tokiwa/).

Balance (4 decimal place accuracy, 0.0001 g for air-dried superabsorbent polymer (ADS SAP) and tea bag weights); timer; 1% saline; drip rack with clips (NLM 211); and lab centrifuge (NLM 211, Spin-X spin extractor, model 776S, 3,300 RPM, 120v).

Test Procedure:

1. Determine solids content of ADS.
2. Pre-weigh tea bags to nearest 0.0001 g and record.
3. Accurately weigh 0.2025 g+/−0.0025 g of test material (SAP), record and place into pre-weighed tea bag (air-dried (AD) bag weight). (ADS weight+AD bag weight=total dry weight).
4. Fold tea bag edge over closing bag.
5. Fill a container (at least 3 inches deep) with at least 2 inches with 1% saline.
6. Hold tea bag (with test sample) flat and shake to distribute test material evenly through bag.
7. Lay tea bag onto surface of saline and start timer.
8. Soak bags for specified time (e.g., 30 minutes).
9. Remove tea bags carefully, being careful not to spill any contents from bags, hang from a clip on drip rack for 3 minutes.
10. Carefully remove each bag, weigh, and record (drip weight).
11. Place tea bags onto centrifuge walls, being careful not to let them touch and careful to balance evenly around wall.
12. Lock down lid and start timer. Spin for 75 seconds.
13. Unlock lid and remove bags. Weigh each bag and record weight (centrifuge weight).

Calculations:

The tea bag material has an absorbency determined as follows:

Free Swell Capacity, factor=5.78

Centrifuge Capacity, factor=0.50

Z=Oven dry SAP wt (g)/Air dry SAP wt (g)

Free Capacity (g/g):

$$\frac{[(\text{drip wt (g)} - \text{dry bag wt (g)}) - (AD\ SAP\ \text{wt (g)})] - (\text{dry bag wt (g)} * 5.78)}{(AD\ SAP\ \text{wt (g)} * Z)}$$

Centrifuge Retention Capacity (g/g):

$$\frac{[\text{centrifuge wt (g)} - \text{dry bag wt (g)} - (AD\ SAP\ \text{wt (g)})] - (\text{dry bag wt (g)} * 0.50)}{(AD\ SAP\ \text{wt} * Z)}$$

Absorbency Under Load (AUL)

The materials, procedure, and calculations to determine ALT were as follows.

Test Materials:

Mettler Toledo PB 3002 balance and BALANCE-LINK software or other compatible balance and software. Software set-up: record weight from balance every 30 sec (this will be a negative number. Software can place each value into EXCEL spreadsheet.

Kontes 90 mm ULTRA-WARE filter set up with fritted glass (coarse) filter plate. clamped to stand; 2 L glass bottle with outlet tube near bottom of bottle; rubber stopper with glass tube through the stopper that fits the bottle (air inlet); TYGON tubing; stainless steel rod/plexiglass plunger assembly (71 mm diameter); stainless steel weight with hole drill through to place over plunger (plunger and weight=867 g); VWR 9.0 cm filter papers (Qualitative 413 catalog number 28310-048) cut down to 80 mm size; double-stick SCOTCH tape; and 0.9% saline.

Test Procedure:

1. Level filter set-up with small level.
2. Adjust filter height or fluid level in bottle so that fritted glass filter and saline level in bottle are at same height.
3. Make sure that there are no kinks in tubing or air bubbles in tubing or under fritted glass filter plate.
4. Place filter paper into filter and place stainless steel weight onto filter paper.
5. Wait for 5-10 min while filter paper becomes fully wetted and reaches equilibrium with applied weight.
6. Zero balance.
7. While waiting for filter paper to reach equilibrium prepare plunger with double stick tape on bottom.
8. Place plunger (with tape) onto separate scale and zero scale.
9. Place plunger into dry test material so that a monolayer of material is stuck to the bottom by the double stick tape.
10. Weigh the plunger and test material on zeroed scale and record weight of dry test material (dry material weight 0.15 g+1-0.05 g).
11. Filter paper should be at equilibrium by now, zero scale.
12. Start balance recording software.
13. Remove weight and place plunger and test material into filter assembly.
14. Place weight onto plunger assembly.
15. Wait for test to complete (30 or 60 min)
16. Stop balance recording software.

Calculations:

A=balance reading (g)*−1 (weight of saline absorbed by test material)

B=dry weight of test material (this can be corrected for moisture by multiplying the AD weight by solids %).

$$AUL(g/g)=A/B(g\ 1\%\ \text{saline}/1\ \text{g test material})$$

The following examples are provided for the purpose of illustrating, not limiting, the invention.

EXAMPLES

Example 1

The Preparation of Representative Mixed Polymer Composite Fibers: Aluminum Sulfate and Boric Acid/Aluminum Sulfate and Boric Acid Crosslinking In this example, the preparation of representative mixed polymer composite fibers crosslinked with aluminum sulfate/boric acid and aluminum sulfate is described.

A solution of CMC 9H4F 10.0 g OD in 900 ml deionized (DI) water was prepared with vigorous stirring to obtain a CMC solution. (0.6 g) was dissolved in 50 ml DI water and mix well with the CMC solution. The solution was stirred for one hour to allow complete mixing of the two polymers.

The polymer mixture was blended in the blender for 5 minutes. Fully dissolve boric acid 0.1 g in 30 ml DI water. Weigh 0.6 g aluminum sulfate octadecahydrate and dissolve in 20 ml DI water. Transfer boric acid solution and aluminum sulfate solution to the polymer solution and blend for 5 minutes to mix to provide a gel. Leave the gel at ambient temperature (25 C) for one hour. Transfer the gel into a large plastic beaker with 2 liters of denatured ethanol and stir for one hour using an overhead stirrer. Filter the precipitate and place in 1 liter dry denatured ethanol for one hour. Filter the precipitate and air dry.

Dissolve 0.3 g of boric acid and 0.75 g of aluminum sulfate octadecahydrate in 150 ml of deionized water and mix with 450 ml of denatured ethanol. To the stirred solution add 6.0 g of fiber, prepared as described above, and leave for 20 minutes at 25° C. Filter the fiber and press free of excess solution. Air dry the resulting product fiber at 25° C. Free swell (59.39 g/g), centrifuge retention capacity (32.8 g/g), AUL at 0.3 psi (28.22 g/g) for 0.9% saline solution.

Example 2

The Preparation of Representative Mixed Polymer Composite Fibers: Aluminum Sulfate and Boric Acid/Aluminum Sulfate and Boric Acid Crosslinking In this example, the preparation of representative mixed polymer composite fibers crosslinked with aluminum sulfate/boric acid and aluminum sulfate/boric acid is described. A solution of CMC 9H4F (5.0 g OD) in 450 ml deionized water was prepared with vigorous stirring to obtain a CMC solution. (0.3 g) was dissolved in 25 ml DI water and mixed with the CMC solution. The solution was stirred for one hour to allow complete mixing of the two polymers.

The polymer mixture was blended in the blender for 5 minutes. Fully dissolve boric acid 0.05 g in 15 ml DI water. Weigh 0.2 g aluminum sulfate octadecahydrate and dissolve in 10 ml DI water. Transfer boric acid solution and aluminum sulfate solution to the polymer solution and blend for 5 minutes to mix well. Leave the gel at ambient temperature (25° C.) for one hour. Transfer the gel into a disintegrator with 1.5 liters of denatured ethanol. Mix for 5 minutes (blades round and dull to avoid fiber damage and 2 rev/sec) and filter the precipitate. To 400 ml of the filtrate add 50 ml aqueous solution containing 0.25 g of boric acid and 0.7 g of aluminum sulfate octadecahydrate. Add the fiber back into the crosslinking solution. Allow crosslinking to continue for 20 minutes. Filter and place the fiber in 500 ml of denatured ethanol and mix for 15 minutes. Filter the product fiber and dry in an oven at 50° C. for 15 minutes and then air dry at 25° C. with fluffing. Free swell (55.63 g/g), centrifuge retention capacity (23.63 g/g), AUL at 0.3 psi (32.02 g/g) for 0.9% saline solution.

Example 3

The Preparation of Representative Mixed Polymer Composite Fibers: Aluminum Sulfate/Aluminum Sulfate Crosslinking In this example, the preparation of representative mixed polymer composite fibers crosslinked with aluminum sulfate and aluminum sulfate is described.

A solution of CMC 9H4F (5.0 g OD) in 450 ml deionized water was prepared with vigorous stirring to obtain a CMC solution. (0.3 g) was dissolved in 25 ml DI water and mixed with the CMC solution. The solution was stirred for one hour to allow complete mixing of the two polymers.

The polymer mixture was blended in the blender for 5 minutes. Weigh 0.3 g aluminum sulfate octadecahydrate and dissolve in 25 ml DI water. Transfer aluminum sulfate solution to the polymer solution and blend for 5 minutes to mix well. Leave the gel at ambient temperature (25° C.) for one hour. Transfer the gel into a Hobart type blender with 1.5 liters of denatured ethanol. Mix for 15 minutes (anchor type blades) and filter the precipitate. To 400 ml of the filtrate add 50 ml aqueous solution containing 0.75 g of aluminum sulfate octadecahydrate. Add the fiber back into the crosslinking solution. Allow the crosslinking to continue for 20 minutes. Filter and place the fiber in 500 ml of denatured ethanol and mix for 15 minutes. Filter the product fiber and dry in an oven at 50° C. for 15 minutes and then air dry at 25° C. with fluffing. Free swell (56.35 g/g), centrifuge retention capacity (32.8 g/g), AUL at 0.3 psi (29.35 g/g) for 0.9% saline solution.

Example 4

The Preparation of Representative Mixed Polymer Composite Fibers. Aluminum Sulfate and Boric Acid/Aluminum Sulfate Crosslinking In this example, the preparation of representative mixed polymer composite fibers crosslinked with aluminum sulfate/boric acid and aluminum sulfate is described.

A solution of CMC 9H4F (10.0 g OD) in 900 ml deionized water was prepared with vigorous stirring to obtain a CMC solution. (0.6 g) was dissolved in 50 ml DI water and mix well with the CMC solution. The solution was stirred for one hour to allow complete mixing of the two polymers.

The polymer mixture was blended in the blender for 5 minutes. Weigh 0.4 g aluminum sulfate octadecahydrate and 0.1 g boric acid and dissolve in 50 ml DI water. Transfer aluminum sulfate and boric acid solution to the polymer solution and blend for 5 minutes to mix well. Leave the gel at ambient temperature (25° C.) for one hour. Transfer the gel into a Waring type blender with one liter of isopropanol. Mix for 1 minute at low speed (gave a softer gel). Transfer the gel to a 5 gallon plastic bucket. Add two liters of isopropanol and mix rapidly with the vertical spiral mixer for 30 minutes. Filter and place the fiber in 500 ml of isopropanol and leave for 15 minutes. Filter the fiber and dry in an oven at 66° C. for 15-30 minutes.

Dissolve 0.32 g of aluminum sulfate octadecahydrate in 100 ml of deionized water and mix with 300 ml of denatured ethanol. To the stirred solution add 2.0 g fiber, prepared as described above, and leave for 30 minutes at 25° C. Filter the SAP and press excess solution out of the SAP. Filter and dry the product fiber at 66° C. for 15 minutes in an oven. Free swell (67.09 g/g), centrifuge retention capacity (33.28 g/g), AUL at 0.3 psi (29.02 g/g) for 0.9% saline solution.

Example 5

The Preparation of Representative Mixed Polymer Composite Fibers: Aluminum Sulfate/Aluminum Sulfate Crosslinking In this example, the preparation of representative mixed polymer composite fibers crosslinked with aluminum sulfate and aluminum sulfate is described.

A solution of CMC 9H4F (10.0 g OD) in 900 ml deionized water was prepared with vigorous stirring to obtain a solution. (0.6 g) was dissolved in 50 ml DI water and mixed well with the CMC solution. The solution was stirred for one hour to allow complete mixing of the two polymers.

The polymer mixture was blended in the blender for 5 minutes. Weigh 0.4 g aluminum sulfate octadecahydrate and dissolve in 50 ml DI water. Transfer aluminum sulfate solution to the polymer solution and blend for 5 minutes to mix well. Leave the gel at ambient temperature (25° C.) for one hour. Transfer the gel into a Waring type blender with one liter of isopropanol. Mix for 1 minute at low speed (gave a softer gel). Transfer the gel to a 5 gallon plastic bucket. Add two liters of isopropanol and mix rapidly with the vertical spiral mixer for 30 minutes. Filter and place the fiber in 500 ml of isopropanol and leave for 15 minutes. Filter the fiber and dry in an oven at 66° C.

Dissolve 0.34 g of aluminum sulfate octadecabydrate in 100 ml of deionized water and mix with 300 ml of denatured ethanol. To the stirred solution add 2.0 g of fiber, prepared as described above, and leave for 30 minutes at 25° C. Filter the fiber and press excess solution. Filter and dry the product fiber at 66° C. for 15 minutes in an oven. Free swell (63.53 g/g), centrifuge retention capacity (28.58 g/g), AUL at 0.3 psi (22.15 g/g) for 0.9% saline solution.

Example 6

The Preparation of Representative Mixed Polymer Composite Fibers: Ammonium Zirconium Carbonate/Aluminum Sulfate Crosslinking In this example, the preparation of representative mixed polymer composite fibers crosslinked with ammonium zirconium carbonate and aluminum sulfate is described.

A solution of CMC 9H4F (10.0 g OD) in 900 ml deionized water was prepared with vigorous stirring to obtain a smooth solution. (0.6 g) was dissolved in 50 ml DI water and mixed well with the CMC solution. The solution was stirred for one hour to allow complete mixing of the two polymers.

The polymer mixture was blended using a kitchen blender for 5 minutes. Weigh 0.5 g of ammonium zirconium carbonate solution in water (15% $ZrO_2$ and dissolve in 50 ml DI water. Transfer the ammonium zirconium carbonate solution to the polymer solution and blend for 5 minutes. Heat the gel at 75° C. for 2 hours. Transfer the gel into a Waring type blender with one liter of isopropanol. Mix for one minute at low speed to form a softer gel. Transfer the gel into 5 gallon plastic bucket. Add two liters of isopropanol and mix rapidly with the vertical spiral mixer for 30 minutes. Filter and place the fiber in 500 ml of isopropanol and stir for 15 minutes. Filter and dry the fiber in an oven at 66° C. for 15 minutes.

Dissolve 0.16 g of aluminum sulfate octadecahydrate in 25 ml DI water and mix with 75 ml of isopropanol. To the solution add 1.0 g of fiber, prepared as described above, and stir for 30 minutes at 25° C. Filter and dry the product fiber in an oven at 66° C. for 15 minutes. Free swell (45.01 g/g), centrifuge retention capacity (22.73 μg), AUL at 0.3 psi (23.06 g/g) for 0.9% saline solution.

Example 7

The Preparation of Representative Mixed Polymer Composite Fibers: Bismuth Ammonium Citrate/Aluminum Sulfate Crosslinking In this example, the preparation of representative mixed polymer composite fibers crosslinked with bismuth ammonium citrate and aluminum sulfate is described.

A solution of CMC 9H4F (10.0 g OD) in 900 ml deionized water was prepared with vigorous stirring to obtain a solution. (0.6 g) was dissolved in 50 ml DI water and mixed well with the CMC solution. The solution was stirred for one hour to allow complete mixing of the two polymers.

The polymer mixture was heated at 80° C. for 45 minutes and then blended using a kitchen blender for 5 minutes. Weigh 0.4 g of bismuth ammonium citrate and dissolve in 50 ml of DI water. Transfer the bismuth ammonium citrate suspension to the polymer solution and blend for 5 minutes. Heat the gel at 80° C. for 2 hours. Transfer the gel into a Waring type blender with one liter of isopropanol. Mix for one minute at low speed to form a softer gel. Transfer the gel into 5 gallon plastic bucket. Add two liters of isopropanol and mix rapidly with the vertical spiral mixer for 30 minutes. Filter and place the fiber in 500 ml of isopropanol and stir for 15 minutes. Filter the fiber and pass through two times through a fluffer. Dry the fiber in an oven at 66° C. for 15 minutes.

Dissolve 0.16 g of aluminum sulfate octadecahydrate in 25 ml DI water and mix with 75 ml of isopropanol. To the solution add 1.0 g of fiber, prepared as described above, and stir for 30 minutes at 25° C. Filter and dry the product fiber in an oven at 66° C. for 15 minutes. Free swell (55.22 g/g), centrifuge retention capacity (24.00 g/g) for 0.9% saline solution.

Example 8

The Preparation of Representative Mixed Polymer Composite Fibers: Aluminum Sulfate/Aluminum Sulfate Crosslinking In this example, the preparation of representative mixed polymer composite fibers crosslinked with aluminum sulfate and aluminum sulfate is described.

A solution of 0.94 DS Kamloops softwood CMC (10.0 g OD) in 900 ml deionized water was prepared with vigorous stirring to obtain a solution. (0.6 g) was dissolved in 50 ml DI water and mixed well with the CMC solution. The solution was stirred for one hour to allow complete mixing of the two polymers.

The polymer mixture was blended in the blender for 5 minutes. Weigh 0.8 g aluminum sulfate octadecahydrate 50 ml DI water. Transfer the aluminum sulfate solution to the polymer solution and blend for 5 minutes to mix well. Leave the gel at ambient temperature (25° C.) for one hour. Transfer the gel to a 5 gallon plastic bucket. Add three liters of ethanol and mix rapidly with the vertical spiral mixer for 30 minutes. Filter and place the fiber in one liter of ethanol and stir for 15 minutes. Filter the fiber and dry in an oven at 66° C. for 15-30 minutes with fluffing.

Dissolve 1.12 g of aluminum sulfate octadecahydrate in 175 ml of deionized water and mix with 525 ml of denatured ethanol. To the stirred solution add 7.0 g of fiber, prepared as described above, and leave for 30 minutes at 25° C. Filter the product fiber and press excess solution out of the product fiber. Filter and dry the fiber at 66° C. for 15 minutes in an oven. Free swell (51.82 g/g), centrifuge retention capacity (19.55 g/g), AUL at 0.3 psi (23.24 g/g) for 0.9% saline solution.

TABLE 1

Composition and Absorbent Properties of Precipitated Superabsorbent Fiber From Crosslinked Aqueous Mixtures of CMC and Galactomannans

| Sample | CMC | Guar Gum (% wgt total wgt) | First crosslinking agent (% wgt total wgt, applied) | Second crosslinking agent/2 g | Fiber forming solvent | Free Swell (g/g) | CRC (g/g) | AUL (g/g) |
|---|---|---|---|---|---|---|---|---|
| 1 | CMC 9H4F | 5.4 | $Al_2(SO_4)_3$ 2.72%, $B(OH)_3$ 0.9% | 0.1 g BA and 0.125 g $Al_2(SO_4)_3$ | EtOH | 59.39 | 32.8 | 28.22 |
| 2 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 64.96 | 39.85 | 28.88 |
| 3 | CMC 9H4F | 5.4 | $Al_2(SO_4)_3$ 0.9%, $B(OH)_3$ 0.9% | 0.1 g BA and 0.125 g $Al_2(SO_4)_3$ | EtOH | 64.76 | 38.73 | 27.86 |
| 4 | CMC 9H4F | 5.4 | $Al_2(SO_4)_3$ 2.75% | 0.1 g BA and 0.125 g $Al_2(SO_4)_3$ | EtOH | 57.2 | 32.71 | 29.51 |
| 5 | CMC 9H4F | 5.4 | $Al_2(SO_4)_3$ 2.72%, $B(OH)_3$ 0.9% | 0.1 g BA and 0.125 g $Al_2(SO_4)_3$ | EtOH | 53.45 | 19.07 | 37.95 |
| 6 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 57.84 | 32.51 | 29.91 |
| 7 | CMC 9H4F | 5.4 | $Al_2(SO_4)_3$ 0.9%, $B(OH)_3$ 0.9% | 0.1 g BA and 0.125 g $Al_2(SO_4)_3$ | EtOH | 57.18 | 32.06 | 34.24 |
| 8 | CMC 9H4F | 5.4 | $Al_2(SO_4)_3$ 2.75% | 0.1 g BA and 0.125 g $Al_2(SO_4)_3$ | EtOH | 55.2 | 25.4 | 31.84 |
| 9 | CMC 9H4F | 5.4 | $Al_2(SO_4)_3$ 2.72%, $B(OH)_3$ 0.9% | 0.1 g BA and 0.15 g $Al_2(SO_4)_3$ | EtOH | 52.85 | 27.88 | 33.84 |
| 10 | CMC 9H4F | 5.4 | $Al_2(SO_4)_3$ 1.83%, $B(OH)_3$ 0.9% | 0.1 g BA and 0.15 g $Al_2(SO_4)_3$ | EtOH | 48.05 | 23.49 | 33.46 |
| 11 | CMC 9H4F | 5.4 | $Al_2(SO_4)_3$ 0.9%, $B(OH)_3$ 0.9% | 0.1 g BA and 0.15 g $Al_2(SO_4)_3$ | EtOH | 51.16 | 24.14 | 28.02 |
| 12 | CMC 9H4F | 5.4 | $Al_2(SO_4)_3$ 2.75% | 0.1 g BA and 0.15 g $Al_2(SO_4)_3$ | EtOH | 45.65 | 22.12 | 27.55 |
| 13 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 55.75 | 29.61 | 31.95 |
| 14 | CMC 9H4F | 5.4 | $Al_2(SO_4)_3$ 1.83%, $B(OH)_3$ 0.9% | 0.1 g BA and 0.15 g $Al_2(SO_4)_3$ | EtOH | 51.01 | 19.46 | 26.11 |
| 15 | CMC 9H4F | 5.4 | $Al_2(SO_4)_3$ 2.75% | 0.1 g BA and 0.125 g $Al_2(SO_4)_3$ | EtOH | 51.09 | 27.93 | 29.57 |
| 16 | CMC 9H4F | 5.4 | $Al_2(SO_4)_3$ 2.75% | 0.1 g BA and 0.15 g $Al_2(SO_4)_3$ | EtOH | 49.69 | 23.12 | 27.8 |
| 17 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 61.98 | 38.07 | 28.48 |
| 18 | CMC 9H4F | 5.4 | $Al_2(SO_4)_3$ 0.9%, $B(OH)_3$ 0.9% | 0.1 g BA and 0.15 g $Al_2(SO_4)_3$ | EtOH | 61.85 | 39.62 | 28.8 |
| 19 | CMC 9H4F | 5.4 | $Al_2(SO_4)_3$ 2.72%, $B(OH)_3$ 0.9% | 0.1 g BA and 0.125 g $Al_2(SO_4)_3$ | EtOH | 42.32 | 24.64 | 21.44 |
| 20 | CMC 9H4F | 5.4 | $Al_2(SO_4)_3$ 2.72%, $B(OH)_3$ 0.9% | 0.1 g BA and 0.125 g $Al_2(SO_4)_3$ | EtOH | 54.17 | 29.68 | 26.4 |
| 21 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 47.96 | 27.92 | 24.24 |
| 22 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 49.97 | 26.34 | 24.33 |
| 23 | CMC 9H4F | 5.4 | $Al_2(SO_4)_3$ 1.83%, $B(OH)_3$ 0.9% | 0.1 g BA and 0.125 g $Al_2(SO_4)_3$ (15 min) | EtOH | 56.32 | 28.71 | 31.44 |
| 24 | CMC 9H4F | 5.4 | $Al_2(SO_4)_3$ 1.83%, $B(OH)_3$ 0.9% | 0.1 g BA and 0.125 g $Al_2(SO_4)_3$ (30 min) | EtOH | 54.17 | 26.12 | 33.17 |
| 25 | CMC 9H4F | 5.4 | $Al_2(SO_4)_3$ 1.83%, $B(OH)_3$ 0.9% | 0.1 g BA and 0.125 g $Al_2(SO_4)_3$ (45 min) | EtOH | 56.1 | 26.73 | 38.84 |
| 26 | CMC 9H4F | 5.4 | $Al_2(SO_4)_3$ 1.83%, $B(OH)_3$ 0.9% | 0.1 g BA and 0.125 g $Al_2(SO_4)_3$ (1 hr) | EtOH | 54.66 | 27.8 | 35.15 |
| 27 | CMC 9H4F | 5.4 | $Al_2(SO_4)_3$ 1.83%, $B(OH)_3$ 0.9% | 0.1 g BA and 0.125 g $Al_2(SO_4)_3$ (20 min) | EtOH | 58.49 | 28.89 | 32.88 |
| 28 | CMC 9H4F | 5.4 | $Al_2(SO_4)_3$ 1.83%, $B(OH)_3$ 0.9% | 0.1 g BA and 0.14 g $Al_2(SO_4)_3$ (20 min) | EtOH | 54.43 | 23.89 | 30.8 |
| 29 | CMC 9H4F | 5.4 | $Al_2(SO_4)_3$ 1.83%, $B(OH)_3$ 0.9% | 0.1 g BA and 0.15 g $Al_2(SO_4)_3$ (20 min) | EtOH | 52.22 | 23.47 | 37.91 |
| 30 | CMC 9H4F | 5.4 | $Al_2(SO_4)_3$ 1.83%, $B(OH)_3$ 0.9% | 0.1 g BA and 0.15 g $Al_2(SO_4)_3$ (20 min) | EtOH | 51.35 | 20.37 | 33.6 |
| 31 | CMC 9H4F | 5.4 | $Al_2(SO_4)_3$ 1.83%, $B(OH)_3$ 0.9% | 0.1 g BA and 0.14 g $Al_2(SO_4)_3$ (20 min) | EtOH | 55.63 | 23.63 | 32.02 |
| 32 | CMC 9H4F | 5.4 | $Al_2(SO_4)_3$ 1.83%, $B(OH)_3$ 0.9% | 0.1 g BA and 0.14 g $Al_2(SO_4)_3$ (20 min) | EtOH | 51.91 | 28.73 | 30.71 |
| 33 | CMC 9H4F | 5.4 | $Al_2(SO_4)_3$ 1.83%, $B(OH)_3$ 0.9% | 0.1 g BA and 0.14 g $Al_2(SO_4)_3$ (20 min) | EtOH | 56.4 | 30.97 | 31.86 |
| 34 | CMC 9H4F | 5.4 | $Al_2(SO_4)_3$ 1.83%, $B(OH)_3$ 0.9% | 0.1 g BA and 0.14 g $Al_2(SO_4)_3$ (20 min) | EtOH | 58.8 | 32.59 | 40.62 |
| 35 | CMC 9H4F | 5.4 | $Al_2(SO_4)_3$ 1.83%, $B(OH)_3$ 0.9% | 0.1 g BA and 0.15 g $Al_2(SO_4)_3$ (20 min) | EtOH | 59.3 | 37.35 | 39.44 |
| 36 | CMC 9H4F | 5.4 | $Al_2(SO_4)_3$ 1.83%, $B(OH)_3$ 0.9% | 0.1 g BA and 0.15 g $Al_2(SO_4)_3$ (20 min) | EtOH | 54.15 | 26.14 | 28.13 |
| 37 | CMC 9H4F | 5.4 | $Al_2(SO_4)_3$ 1.83%, $B(OH)_3$ 0.9% | 0.15 g $Al_2(SO_4)_3$ (20 min) | EtOH | 62.15 | 39.24 | 35.97 |

TABLE 1-continued

Composition and Absorbent Properties of Precipitated Superabsorbent Fiber From Crosslinked Aqueous Mixtures of CMC and Galactomannans

| Sample | CMC | Guar Gum (% wgt total wgt) | First crosslinking agent (% wgt total wgt, applied) | Second crosslinking agent/2 g | Fiber forming solvent | Free Swell (g/g) | CRC (g/g) | AUL (g/g) |
|---|---|---|---|---|---|---|---|---|
| 38 | CMC 9H4F | 5.4 | $Al_2(SO_4)_3$ 2.75% | 0.15 g $Al_2(SO_4)_3$ (20 min) | EtOH | 56.35 | 32.8 | 29.35 |
| 39 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 48.36 | 25.87 | |
| 40 | CMC 9H4F | 5.4 | $Al_2(SO_4)_3$ 2.75% | 0.14 g $Al_2(SO_4)_3$ | EtOH | 52.9 | 30.49 | |
| 41 | CMC 9H4F | 5.4 | $Al_2(SO_4)_3$ 1.85% | 0.14 g $Al_2(SO_4)_3$ | EtOH | 51.63 | 23.64 | |
| 42 | CMC 9H4F | 5.4 | $Al_2(SO_4)_3$ 1.83%, $B(OH)_3$ 0.9% | 0.14 g $Al_2(SO_4)_3$ wo washing | EtOH | 55.41 | 21.93 | 28.81 |
| 43 | CMC 9H4F | 5.4 | $Al_2(SO_4)_3$ 1.38%, $B(OH)_3$ 0.9% | 0.14 g $Al_2(SO_4)_3$ wo washing | EtOH | 59.9 | 24.81 | 29.36 |
| 44 | CMC 9H4F | 5.4 | $Al_2(SO_4)_3$ 0.9%, $B(OH)_3$ 0.9% | 0.14 g $Al_2(SO_4)_3$ wo washing | EtOH | 56.16 | 21.56 | 30.63 |
| 45 | CMC 9H4F | 5.4 | $Al_2(SO_4)_3$ 2.75% | 0.14 g $Al_2(SO_4)_3$ wo washing | EtOH | 57.02 | 25.59 | 31.33 |
| 46 | CMC 9H4F | 5.4 | $Al_2(SO_4)_3$ 1.83%, $B(OH)_3$ 0.9% | 0.15 g $Al_2(SO_4)_3$ wo washing | EtOH | 51.31 | 31.24 | |
| 47 | CMC 9H4F | 5.4 | $Al_2(SO_4)_3$ 1.83%, $B(OH)_3$ 0.9% | 0.15 g $Al_2(SO_4)_3$ wo washing | EtOH | 52.74 | 22.05 | |
| 48 | CMC 9H4F | 5.4 | $Al_2(SO_4)_3$ 1.83%, $B(OH)_3$ 0.9% | 0.15 g $Al_2(SO_4)_3$ wo washing | EtOH | 54.94 | 31.98 | |
| 49 | CMC 9H4F | 5.4 | $Al_2(SO_4)_3$ 1.83%, $B(OH)_3$ 0.9% | 0.15 g $Al_2(SO_4)_3$ wo washing | EtOH | 54.12 | 23.07 | |
| 50 | CMC 9H4F | 5.4 | $Al_2(SO_4)_3$ 1.83%, $B(OH)_3$ 0.9% | 0.16 g $Al_2(SO_4)_3$ wo washing | EtOH | 56.99 | 38.26 | |
| 51 | CMC 9H4F | 5.4 | $Al_2(SO_4)_3$ 1.83%, $B(OH)_3$ 0.9% | 0.16 g $Al_2(SO_4)_3$ wo washing | EtOH | 52.69 | 22.99 | |
| 52 | CMC 9H4F | 5.4 | $Al_2(SO_4)_3$ 1.83%, $B(OH)_3$ 0.9% | 0.16 g $Al_2(SO_4)_3$ wo washing | EtOH | 55.3 | 27.09 | |
| 53 | CMC 9H4F | 5.4 | $Al_2(SO_4)_3$ 1.83%, $B(OH)_3$ 0.9% | 0.16 g $Al_2(SO_4)_3$ wo washing | EtOH | 53.3 | 20.99 | |
| 54 | CMC 9H4F | 5.4 | $Al_2(SO_4)_3$ 1.83%, $B(OH)_3$ 0.9% | 0.125 g $Al_2(SO_4)_3$ wo washing | EtOH | 56.72 | 36.19 | |
| 55 | CMC 9H4F | 5.4 | $Al_2(SO_4)_3$ 1.83%, $B(OH)_3$ 0.9% | 0.14 g $Al_2(SO_4)_3$ wo washing | EtOH | 55.21 | 26.92 | |
| 56 | CMC 9H4F | 5.4 | $Al_2(SO_4)_3$ 1.83%, $B(OH)_3$ 0.9% | 0.15 g $Al_2(SO_4)_3$ wo washing | EtOH | 52.03 | 22.84 | |
| 57 | CMC 9H4F | 5.4 | $Al_2(SO_4)_3$ 1.83%, $B(OH)_3$ 0.9% | 0.16 g $Al_2(SO_4)_3$ wo washing | EtOH | 50.54 | 22.35 | |
| 58 | CMC 9H4F | 5.4 | $Al_2(SO_4)_3$ 1.83%, $B(OH)_3$ 0.9% | 0.17 g $Al_2(SO_4)_3$ wo washing | EtOH | 50.51 | 21.87 | |
| 59 | CMC 9H4F | 5.4 | $Al_2(SO_4)_3$ 1.83%, $B(OH)_3$ 0.9% | 0.18 g $Al_2(SO_4)_3$ wo washing | EtOH | 48.95 | 21.16 | |
| 60 | CMC 9H4F | 5.4 | $Al_2(SO_4)_3$ 1.83%, $B(OH)_3$ 0.9% | 0.18 g $Al_2(SO_4)_3$ wo washing | EtOH | 48.22 | 19.81 | |
| 61 | CMC 9H4F | 5.5 | $Al_2(SO_4)_3$ 2.75% | 0.16 g $Al_2(SO_4)_3$ wo washing | EtOH | 48.54 | 14.29 | |
| 62 | CMC 9H4F | 5.5 | $Al_2(SO_4)_3$ 2.75% | 0.16 g $Al_2(SO_4)_3$ wo washing | EtOH | 57.53 | 27 | |
| 63 | CMC 9H4F | 5.4 | $Al_2(SO_4)_3$ 3.63% | 0.14 g $Al_2(SO_4)_3$ wo washing | EtOH | 65.09 | 33.7 | |
| 64 | CMC 9H4F | 5.4 | $Al_2(SO_4)_3$ 4.5% | 0.14 g $Al_2(SO_4)_3$ wo washing | EtOH | 66.19 | 38.01 | |
| 65 | CMC 9H4F | 5.5 | $Al_2(SO_4)_3$ 2.75% | 0.16 g $Al_2(SO_4)_3$ wo washing | i-PrOH | 58.59 | 29.87 | |
| 66 | CMC 9H4F | 5.5 | $Al_2(SO_4)_3$ 2.75% | 0.16 g $Al_2(SO_4)_3$ wo washing | i-PrOH | 53.88 | 26.15 | |
| 67 | CMC 9H4F | 5.5 | $Al_2(SO_4)_3$ 1.83%, $B(OH)_3$ 0.9% | 0.16 g $Al_2(SO_4)_3$ wo washing | i-PrOH | 67.09 | 33.28 | 29.02 |
| 68 | CMC 9H4F | 5.5 | $Al_2(SO_4)_3$ 1.83%, $B(OH)_3$ 0.9% | 0.16 g $Al_2(SO_4)_3$ wo washing | i-PrOH | 71.19 | 29.36 | 28.47 |
| 69 | CMC 9H4F | 5.5 | $Al_2(SO_4)_3$ 1.85% | 0.17 g $Al_2(SO_4)_3$ wo washing | i-PrOH | 63.53 | 28.58 | 22.15 |
| 70 | CMC 9H4F | 5.5 | $Al_2(SO_4)_3$ 1.85% | 0.17 g $Al_2(SO_4)_3$ wo washing | i-PrOH | 55.18 | 20.25 | 22.24 |
| 71 | CMC 9H4F | 5.5 | $Al_2(SO_4)_3$ 1.84%, $B(OH)_3$ 0.46% | 0.13 g $Al_2(SO_4)_3$ wo washing | i-PrOH | 36.78 | 7.1 | |
| 72 | CMC 9H4F | 5.5 | $Al_2(SO_4)_3$ 1.83%, $B(OH)_3$ 0.9% | 0.16 g $Al_2(SO_4)_3$ wo washing | i-PrOH | 57.89 | 18.42 | 23.91 |
| 73 | CMC 9H4F | 5.5 | $Al_2(SO_4)_3$ 1.83%, $B(OH)_3$ 0.9% | 0.16 g $Al_2(SO_4)_3$ wo washing | i-PrOH | 52.98 | 12.91 | 23.62 |
| 74 | CMC 9H4F | 5.5 | $Al_2(SO_4)_3$ 1.85% | 0.17 g $Al_2(SO_4)_3$ wo washing | i-PrOH | 44.74 | 12.08 | 19.42 |
| 75 | CMC 9H4F | 5.5 | $Al_2(SO_4)_3$ 1.85% | 0.17 g $Al_2(SO_4)_3$ wo washing | i-PrOH | 49.53 | 15.92 | 25.2 |
| 76 | PA-CMC | 5.4 | $Al_2(SO_4)_3$ 0.23%, $B(OH)_3$ 0.9% | 0.1 g BA and 0.14 g $Al_2(SO_4)_3$ | EtOH | 48.11 | 22 | 29.7 |
| 77 | PA-CMC | 5.4 | $Al_2(SO_4)_3$ 0.69%, $B(OH)_3$ 0.9% | 0.1 g BA and 0.14 g $Al_2(SO_4)_3$ | EtOH | 46.89 | 20.14 | 25.48 |
| 78 | PA-CMC | 5.4 | $Al_2(SO_4)_3$ 2.72%, $B(OH)_3$ 0.9% | 0.05 g BA and 0.16 g $Al_2(SO_4)_3$ | EtOH | 50.92 | 29.78 | |
| 79 | PA-CMC | 5.4 | $Al_2(SO_4)_3$ 1.83%, $B(OH)_3$ 0.9% | 0.05 g BA and 0.16 g $Al_2(SO_4)_3$ | EtOH | 49.28 | 24.86 | |
| 80 | PA-CMC | 5.4 | $Al_2(SO_4)_3$ 0.9%, $B(OH)_3$ 0.9% | 0.05 g BA and 0.16 g $Al_2(SO_4)_3$ | EtOH | 51.46 | 33.67 | |

TABLE 1-continued

Composition and Absorbent Properties of Precipitated Superabsorbent Fiber From Crosslinked Aqueous Mixtures of CMC and Galactomannans

| Sample | CMC | Guar Gum (% wgt total wgt) | First crosslinking agent (% wgt total wgt, applied) | Second crosslinking agent/2 g | Fiber forming solvent | Free Swell (g/g) | CRC (g/g) | AUL (g/g) |
|---|---|---|---|---|---|---|---|---|
| 81 | PA-CMC | 5.4 | $Al_2(SO_4)_3$ 2.75% | 0.18 g $Al_2(SO_4)_3$ w wash | EtOH | 44.78 | 24.99 | |
| 82 | PA-CMC | 5.4 | $Al_2(SO_4)_3$ 2.72%, $B(OH)_3$ 0.9% | 0.18 g $Al_2(SO_4)_3$ w wash | EtOH | 51.11 | 26.49 | |
| 83 | PA-CMC | 5.4 | $Al_2(SO_4)_3$ 1.83%, $B(OH)_3$ 0.9% | 0.18 g $Al_2(SO_4)_3$ w wash | EtOH | 52.74 | 33.59 | |
| 84 | PA-CMC | 5.4 | $Al_2(SO_4)_3$ 0.9%, $B(OH)_3$ 0.9% | 0.18 g $Al_2(SO_4)_3$ w wash | EtOH | 51.25 | 32.2 | |
| 85 | PA-CMC | 5.4 | $Al_2(SO_4)_3$ 2.75% | 0.18 g $Al_2(SO_4)_3$ w wash | EtOH | 45.64 | 24.85 | |
| 86 | PA-CMC | 5.4 | $Al_2(SO_4)_3$ 2.72%, $B(OH)_3$ 0.9% | 0.18 g $Al_2(SO_4)_3$ w wash | EtOH | 52.09 | 26.85 | |
| 87 | PA-CMC | 54 | $Al_2(SO_4)_3$ 1.83%, $B(OH)_3$ 0.9% | 0.18 g $Al_2(SO_4)_3$ w wash | EtOH | 49.5 | 25.89 | |
| 88 | PA-CMC | 5.4 | $Al_2(SO_4)_3$ 0.9%, $B(OH)_3$ 0.9% | 0.20 g $Al_2(SO_4)_3$ w wash | EtOH | 50.09 | 28.49 | |
| 89 | PA-CMC | 5.4 | $Al_2(SO_4)_3$ 2.75% | 0.18 g $Al_2(SO_4)_3$ w wash | EtOH | 45.47 | 23.07 | |
| 90 | PA-CMC | 5.4 | $Al_2(SO_4)_3$ 2.72%, $B(OH)_3$ 0.9% | 0.18 g $Al_2(SO_4)_3$ w wash | EtOH | 44.04 | 18.61 | |
| 91 | PA-CMC | 5.4 | $Al_2(SO_4)_3$ 1.83%, $B(OH)_3$ 0.9% | 0.18 g $Al_2(SO_4)_3$ w wash | EtOH | 48.37 | 23.07 | |
| 92 | PA-CMC | 5.4 | $Al_2(SO_4)_3$ 0.9%, $B(OH)_3$ 0.9% | 0.20 g $Al_2(SO_4)_3$ w wash | EtOH | 46.14 | 20.36 | |
| 93 | PA-CMC | 5.4 | $Al_2(SO_4)_3$ 2.75% | 0.18 g $Al_2(SO_4)_3$ w wash | EtOH | 47.23 | 19.85 | |
| 94 | PA-CMC | 5.4 | $Al_2(SO_4)_3$ 0.23%, $B(OH)_3$ 0.9% | 0.20 g $Al_2(SO_4)_3$ w wash | EtOH | 49.23 | 26.34 | |
| 95 | PA-CMC | 5.4 | $Al_2(SO_4)_3$ 0.46%, $B(OH)_3$ 0.9% | 0.20 g $Al_2(SO_4)_3$ w wash | EtOH | 45.65 | 20.12 | |
| 96 | PA-CMC | 5.4 | $Al_2(SO_4)_3$ 0.92%, $B(OH)_3$ 0.92% | 0.20 g $Al_2(SO_4)_3$ w wash | EtOH | 43.59 | 14.04 | |
| 97 | PA-CMC | 5.4 | $Al_2(SO_4)_3$ 0.93% | 0.20 g $Al_2(SO_4)_3$ w wash | EtOH | 44.33 | 21.46 | |
| 98 | PA-CMC | 5.4 | $Al_2(SO_4)_3$ 2.72%, $B(OH)_3$ 0.9% | 0.18 g $Al_2(SO_4)_3$ w wash | EtOH | 49.3 | 23.37 | |
| 99 | PA-CMC | 5.4 | $Al_2(SO_4)_3$ 1.83%, $B(OH)_3$ 0.9% | 0.18 g $Al_2(SO_4)_3$ w wash | EtOH | 51.89 | 26.54 | |
| 100 | PA-CMC | 5.4 | $Al_2(SO_4)_3$ 0.9%, $B(OH)_3$ 0.9% | 0.19 g $Al_2(SO_4)_3$ w wash | EtOH | 55.17 | 30.5 | |
| 101 | PA-CMC | 5.4 | $Al_2(SO_4)_3$ 2.75% | 0.18 g $Al_2(SO_4)_3$ w wash | EtOH | 53.54 | 23.73 | |
| 102 | PA-CMC | 5.4 | $Al_2(SO_4)_3$ 2.72%, $B(OH)_3$ 0.9% | 0.18 g $Al_2(SO_4)_3$ w wash | EtOH | 53.61 | 26.9 | |
| 103 | PA-CMC | 5.4 | $Al_2(SO_4)_3$ 1.83%, $B(OH)_3$ 0.9% | 0.18 g $Al_2(SO_4)_3$ w wash | EtOH | 52.88 | 28.25 | |
| 104 | PA-CMC | 5.4 | $Al_2(SO_4)_3$ 0.9%, $B(OH)_3$ 0.9% | 0.20 g $Al_2(SO_4)_3$ w wash | EtOH | 53.24 | 29.94 | |
| 105 | PA-CMC | 5.4 | $Al_2(SO_4)_3$ 2.75% | 0.18 g $Al_2(SO_4)_3$ w wash | EtOH | 51.06 | 25.43 | |
| 106 | PA-CMC | 5.5 | $Al_2(SO_4)_3$ 0.9%, $B(OH)_3$ 0.9% | 0.19 g $Al_2(SO_4)_3$ w wash | EtOH | 50.6 | 20.03 | |
| 107 | PA-CMC | 5.6 | $Al_2(SO_4)_3$ 0.9% | 0.22 g $Al_2(SO_4)_3$ w wash | EtOH | 46.67 | 17.3 | |
| 108 | PA-CMC | None | $Al_2(SO_4)_3$ 0.98%, $B(OH)_3$ 0.98% | 0.19 g $Al_2(SO_4)_3$ w wash | EtOH | 57.07 | 28.68 | |
| 109 | PA-CMC | None | $Al_2(SO_4)_3$ 0.99% | 0.22 g $Al_2(SO_4)_3$ w wash | EtOH | 51.77 | 27.17 | |
| 110 | LV-PN | 5.4 | $Al_2(SO_4)_3$ 3.63% | 0.17 g $Al_2(SO_4)_3$ w wash | EtOH | 54.11 | 20.57 | |
| 111 | LV-HW | 5.4 | $Al_2(SO_4)_3$ 3.63% | 0.17 g $Al_2(SO_4)_3$ w wash | EtOH | 57.05 | 23.92 | |
| 112 | LV-FIR | 5.4 | $Al_2(SO_4)_3$ 3.63% | 0.17 g $Al_2(SO_4)_3$ w wash | EtOH | 59.68 | 24.7 | |
| 113 | KL-SW | 5.4 | $Al_2(SO_4)_3$ 3.63% | 0.17 g $Al_2(SO_4)_3$ w wash | EtOH | 58.06 | 21.12 | |
| 114 | LV-PN | 5.6 | $Al_2(SO_4)_3$ 0.46% | 0.16 g $Al_2(SO_4)_3$ w wash | EtOH | 59.85 | 29.3 | 36.6 |
| 115 | LV-PN | 5.6 | $Al_2(SO_4)_3$ 0.9% | 0.24 g $Al_2(SO_4)_3$ w wash | EtOH | 51.57 | 21.85 | 33.53 |
| 116 | LV-PN | 5.6 | $Al_2(SO_4)_3$ 1.85% | 0.22 g $Al_2(SO_4)_3$ w wash | EtOH | 55.28 | 27.28 | 33.06 |
| 117 | LV-PN | 5.4 | $Al_2(SO_4)_3$ 3.63% | 0.20 g $Al_2(SO_4)_3$ w wash | EtOH | 54.19 | 31.26 | 26.73 |
| 118 | LV-PN | 5.5 | $Al_2(SO_4)_3$ 1.85% | 0.14 g $Al_2(SO_4)_3$ w wash | EtOH | 44.85 | 27.8 | 19.1 |
| 119 | LV-HW | 5.5 | $Al_2(SO_4)_3$ 1.85% | 0.14 g $Al_2(SO_4)_3$ w wash | EtOH | 47.76 | 29.45 | 14.16 |
| 120 | LV-FIR | 5.5 | $Al_2(SO_4)_3$ 1.85% | 0.14 g $Al_2(SO_4)_3$ w wash | EtOH | 46.58 | 31.94 | 32.56 |
| 121 | KL-SW | 5.5 | $Al_2(SO_4)_3$ 1.85% | 0.14 g $Al_2(SO_4)_3$ w wash | EtOH | 49.31 | 28.05 | 28.43 |
| 122 | LV-PN | 5.4 | $Al_2(SO_4)_3$ 3.63% | 0.16 g $Al_2(SO_4)_3$ w wash | EtOH | 55.88 | 22.17 | 22 |
| 123 | LV-HW | 5.4 | $Al_2(SO_4)_3$ 3.63% | 0.16 g $Al_2(SO_4)_3$ w wash | EtOH | 53.75 | 21.49 | 21.44 |
| 124 | LV-FIR | 5.4 | $Al_2(SO_4)_3$ 3.63% | 0.16 g $Al_2(SO_4)_3$ w wash | EtOH | 51.77 | 20.39 | 22.48 |
| 125 | KL-SW | 5.4 | $Al_2(SO_4)_3$ 3.63% | 0.16 g $Al_2(SO_4)_3$ w wash | EtOH | 51.82 | 19.55 | 23.24 |
| 126 | LV-PN | 5.5 | $Al_2(SO_4)_3$ 1.85% | 0.14 g $Al_2(SO_4)_3$ w wash | EtOH | 46.5 | 26.69 | |
| 127 | LV-HW | 5.5 | $Al_2(SO_4)_3$ 1.85% | 0.14 g $Al_2(SO_4)_3$ w wash | EtOH | 48.29 | 29.32 | |
| 128 | LV-FIR | 5.5 | $Al_2(SO_4)_3$ 1.85% | 0.14 g $Al_2(SO_4)_3$ w wash | EtOH | 53.13 | 30.91 | |
| 129 | KL-SW | 5.5 | $Al_2(SO_4)_3$ 1.85% | 0.14 g $Al_2(SO_4)_3$ w wash | EtOH | 50.05 | 29.59 | |

TABLE 2

Metal Analysis Data for Selected Superabsorbent Fiber

| Sample | CMC | Guar Gum (% wgt total wgt) | First crosslinking agent (% wgt total wgt, applied) | Second crosslinking agent/2 g | Fiber forming solvent | Al (mg/kg) | B (mg/kg) |
|---|---|---|---|---|---|---|---|
| 1A | CMC 9H4F | 5.4 | $Al_2(SO_4)_3$ 2.72%, $B(OH)_3$ 0.9% | None | EtOH | 3865 | <60 |
| 1 | CMC 9H4F | 5.4 | $Al_2(SO_4)_3$ 2.72%, $B(OH)_3$ 0.9% | 0.1 g BA and 0.125 g $Al_2(SO_4)_3$ | EtOH | 9785 | 260 |
| 2A | CMC 9H4F | 5.4 | $Al_2(SO_4)_3$ 1.83%, $B(OH)_3$ 0.9% | None | EtOH | 2555 | <60 |
| 2 | CMC 9H4F | 5.4 | $Al_2(SO_4)_3$ 1.83%, $B(OH)_3$ 0.9% | 0.1 g BA and 0.125 g $Al_2(SO_4)_3$ | EtOH | 9465 | 205 |
| 3A | CMC 9H4F | 5.4 | $Al_2(SO_4)_3$ 0.9%, $B(OH)_3$ 0.9% | None | EtOH | 1210 | <60 |
| 3 | CMC 9H4F | 5.4 | $Al_2(SO_4)_3$ 0.9%, $B(OH)_3$ 0.9% | 0.1 g BA and 0.125 g $Al_2(SO_4)_3$ | EtOH | 7920 | 160 |
| 4A | CMC 9H4F | 5.4 | $Al_2(SO_4)_3$ 2.75%, | None | EtOH | 3890 | <60 |
| 4 | CMC 9H4F | 5.4 | $Al_2(SO_4)_3$ 2.75%, | 0.1 g BA and 0.125 g $Al_2(SO_4)_3$ | EtOH | 10750 | 195 |

While illustrative embodiments have been illustrated and described, it will be appreciated that various changes can be made therein without departing from the spirit and scope of the invention.

The embodiments of the invention in which an exclusive property or privilege is claimed are defined as follows:

1. A mixed polymer composite fiber, comprising a carboxyalkyl cellulose and a galactomannan polymer or a glucomannan polymer and a plurality of non-permanent intra-fiber metal crosslinks.

2. The fiber of claim 1, wherein the carboxyalkyl cellulose has a degree of carboxyl group substitution of from about 0.3 to about 2.5.

3. The fiber of claim 1, wherein the carboxyalkyl cellulose is carboxymethyl cellulose.

4. The fiber of claim 1, wherein the galactomannan polymer is selected from the group consisting of guar gum, locust bean gum, tara gum, and fenugreek gum.

5. The fiber of claim 1, wherein the glucomannan polymer is konjac gum.

6. The fiber of claim 1, wherein the carboxyalkyl cellulose is present in an amount from about 60 to about 99 percent by weight based on the total weight of the fiber.

7. The fiber of claim 1, wherein the galactomannan polymer is present in an amount from about 1 to about 20 percent by weight based on the total weight of the fiber.

8. The fiber of claim 1, wherein the glucomannan polymer is present in an amount from about 1 to about 20 percent by weight based on the total weight of the fiber.

9. The fiber of claim 1, wherein the non-permanent intra-fiber metal crosslinks comprise multi-valent metal ion crosslinks.

10. The fiber of claim 9, wherein the multi-valent metal ion crosslinks comprise one or more metal ions selected from the group consisting of aluminum, boron, bismuth, titanium and zirconium ions, and mixtures thereof.

11. The fiber of claim 1 having a free swell capacity of from about 30 to about 60 g/g for 0.9% saline solution.

12. The fiber of claim 1 having a centrifuge retention capacity of from about 15 to about 35 g/g for 0.9% saline solution.

13. The fiber of claim 1 having an absorbency under load capacity of from about 15 to about 30 g/g for 0.9% saline solution.

14. The fiber of claim 1 having a wicking rate of from about 10 mL/sec to about 0.005 mL/sec for 0.9% saline solution.

15. The fiber of claim 1 having a centrifuge retention capacity of from about 15 to about 35 g/g for 0.9% saline solution and a wicking rate of from about 10 mL/sec to about 0.005 mL/sec for 0.9% saline solution.

* * * * *